United States Patent [19]

Schroer et al.

[11] Patent Number: 4,629,096

[45] Date of Patent: Dec. 16, 1986

[54] LIQUID DISPENSER WITH READILY REMOVABLE LIQUID CONTAINER

[75] Inventors: William L. Schroer; Edward H. Donselman, both of Freeport, Ill.

[73] Assignee: Elkay Manufacturing Company, Freeport, Ill.

[21] Appl. No.: 686,690

[22] Filed: Dec. 27, 1984

[51] Int. Cl.[4] ..... B67D 5/62

[52] U.S. Cl. ..... 222/146.6; 62/395; 312/236

[58] Field of Search ..... 222/183, 185, 146.6, 222/146.1, 173, 160; 62/390, 391, 395, 394; 312/223, 236, 242, 312; 220/3.1

[56] References Cited

U.S. PATENT DOCUMENTS

| | | | |
|---|---|---|---|
| 1,809,958 | 6/1931 | Wright | 62/395 |
| 1,930,220 | 10/1933 | Askin | 62/395 |
| 2,291,256 | 7/1942 | Rehrig et al. | 62/395 |
| 2,557,252 | 6/1951 | Bannister et al. | 62/395 |
| 2,681,549 | 6/1954 | Maxwell | 62/395 |
| 3,018,915 | 1/1962 | Larson | 62/395 |
| 3,325,058 | 6/1965 | West, Jr. | 222/146.1 |
| 3,811,294 | 5/1974 | Taylor | 62/390 |

OTHER PUBLICATIONS

Various letters and memos dating from Aug. 9, 1982 to Mar. 28, 1984 relating to the field test of the invention.

*Primary Examiner*—Joseph J. Rolla
*Assistant Examiner*—Kenneth Noland
*Attorney, Agent, or Firm*—Leydig, Voit & Mayer

[57] ABSTRACT

A liquid-dispensing apparatus having a drop-in/lift-out reservoir is provided comprising a housing having an opening in a front vertical wall thereof and a removable top, an insulated receptacle positioned within the housing having a cooling plate within a lower portion of the insulated receptacle, a vertically removable liquid container adapted to be dropped into and lifted out of the insulated receptacle, liquid valve device integrally incorporated in a wall portion of the liquid container and located to project through the opening in the housing and accessible by a user with the liquid container located in the insulated receptacle, and a device for locating the liquid container in the insulated receptacle.

18 Claims, 10 Drawing Figures

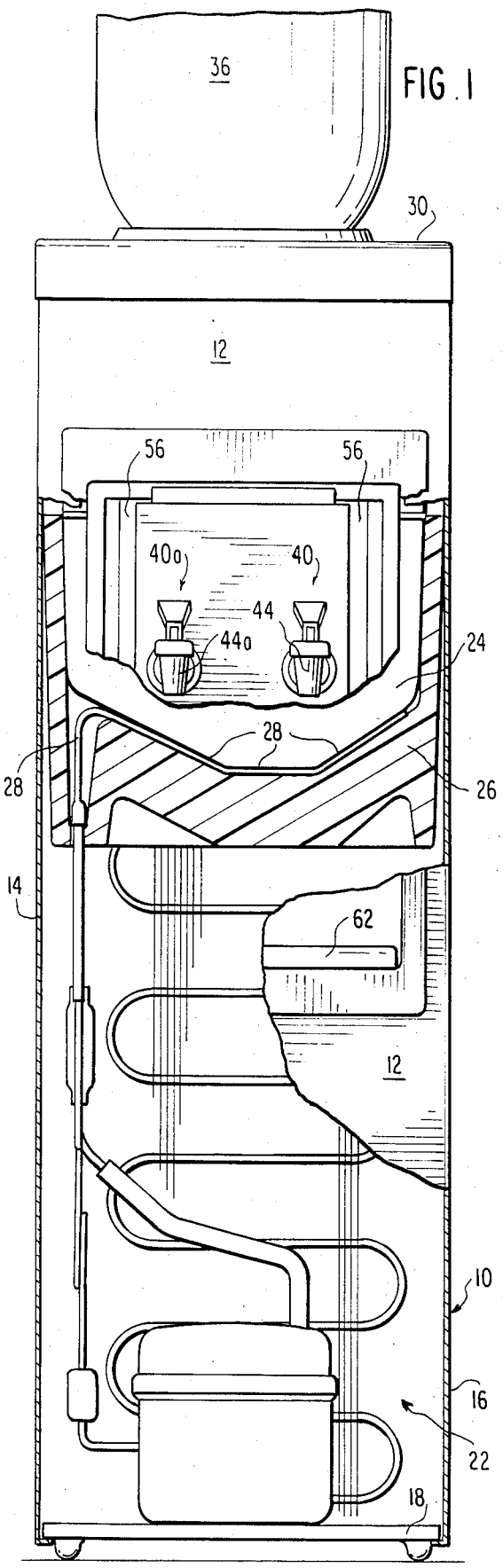
FIG. 1
FIG. 2
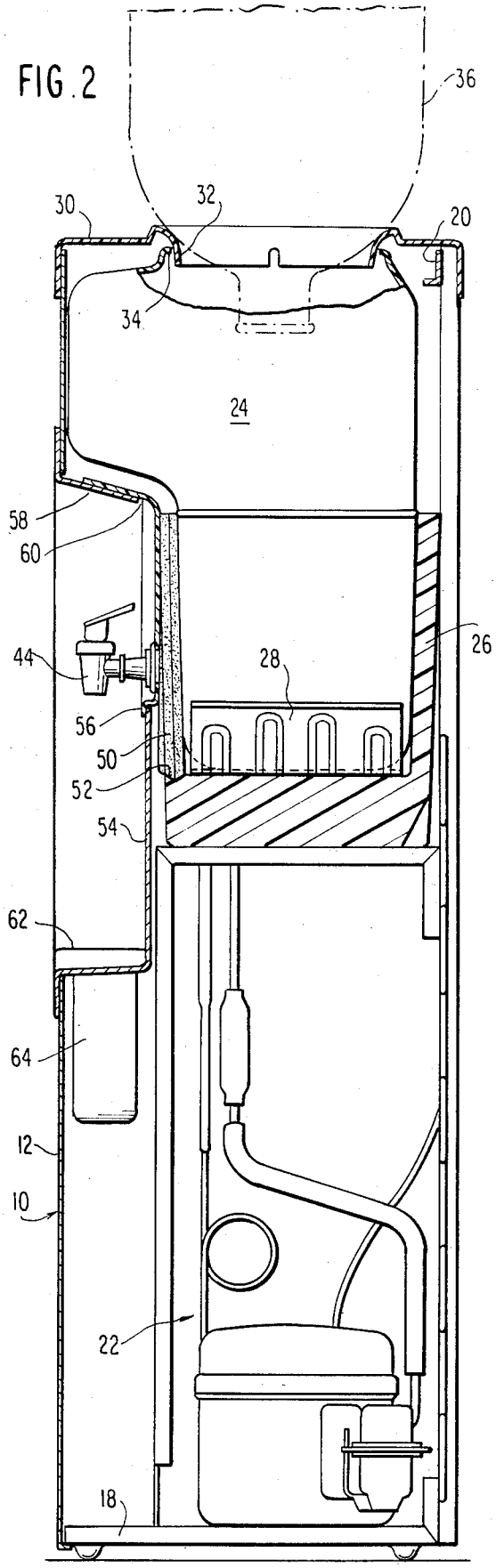

LIQUID DISPENSER WITH READILY REMOVABLE LIQUID CONTAINER

TECHNICAL FIELD

The present invention relates generally to beverage dispensers, such as refrigerated water or beverage coolers. More particularly, the present invention is directed to liquid dispensers which include a liquid container providing a reservoir which may be easily lifted out or dropped into the housing of the cooler.

BACKGROUND ART

Water coolers of the type which are supplied with bottled mineral water have maintained a continued popularity although alternative types of water coolers are available, such as those continuously supplied with mains water. The bottle-type water coolers generally include an upright cabinet or housing containing a refrigeration unit and a liquid container which receives the mouth and neck portion of an inverted water bottle. The liquid container has a liquid dispensing faucet and is positioned adjacent to cooling coils of the refrigeration unit.

Inherent in the design of many of the water coolers or beverage dispensers currently in use are problems associated with sterility or cleanliness. Such problems may result from the materials from which the liquid container, faucet or associated piping is formed. Thus, the potential for oxidation or general deterioration of the materials, particularly rust formation, tends to reduce the usefulness of such apparatus. Additionally, depending upon the location and environment of the dispenser, the type of water or other beverage used in the dispenser, the rate at which the water or other beverage is used, and the care taken to prevent introduction of foreign matter when a water bottle is replaced, particulate and other types of contaminants may be introduced to the liquid container and may be ultimately dispensed through normal operation. To maintain cleanliness, the liquid container of conventional bottle-type water coolers require periodic cleaning to remove sediment or other contaminants, such as algae. The frequency of cleaning required for such water coolers generally depends, at least in part, on the above enumerated conditions.

Some of the difficulties related to maintaining a desirable level of cleanliness in such units are caused by the inaccessibility of the liquid container. Thus, many of the liquid containers are so constructed that it is difficult or impossible to clean all of the internal surfaces with the liquid container in the housing. To remove the liquid container from the housing also proves difficult with most of the water coolers currently being used. To remove the liquid container in most of the water coolers of this type requires either large expenditures of time, the use of tools and in some instances special tools, or the possible destruction of components of the water cooler, particularly seals, in the disassembly procedure, or a combination of the foregoing. The removal procedure and the attendant difficulties associated therewith tend to discourage the periodic maintenance required for cleanliness of such water or beverage dispensing systems.

DISCLOSURE OF INVENTION

In accordance with the present invention, a liquid dispenser is provided which includes a housing, refrigeration equipment located in the housing and a liquid container positioned within an insulated receptacle located in an upper portion of the housing. A cooling plate which is connected to the refrigeration equipment is located in the bottom of the insulated receptacle in contact with a lower portion of the liquid container. When employed as a water cooler using a conventional water bottle or carboy, the housing is provided with a removable top or cover having a hole therein adapted to receive the neck of the carboy. Likewise, the liquid container is provided with an aperture or hole aligned with that of the top to accomodate the neck of the carboy.

To achieve the object of providing a more readily cleanable liquid container, the present invention provides a removable liquid container which may be lifted out from or dropped into the housing vertically after the housing top has been removed. The liquid container includes at least one liquid dispenser or valve means, such as a faucet, incorporated by unitary construction into a wall portion of the liquid container. When the liquid container is located in the housing, within the insulated receptacle, the liquid valve means projects through an opening provided in a wall portion of the housing. Thus, the liquid container may be quickly and easily removed from the housing for cleaning without the necessity of disconnecting the faucet from the liquid container, a procedure which, when conventional water coolers are employed, often requires the use of tools and in some instances special tools, expenditure of time and possible damage to fittings or seals.

The present invention also includes a means for locating the liquid container within the housing such that the liquid container is correctly positioned with the liquid dispensing valve or valves projecting through the opening in the housing and is maintained in this position such that jarring of the housing does not cause significant movement of the liquid container. The locating means may include a plate or panel secured to the wall portion of the liquid container through which the valve means passes, which panel engages a wall portion of the insulated receptacle in which the liquid container is located. Another locating means may include an escutcheon plate secured to the liquid container on the wall portion through which the valve means passes, possibly with the panel positioned intermediate the escutcheon plate and the wall portion of the liquid container. With this arrangement, the escutcheon plate is located in register with and engages the wall portion of the housing which is provided with the opening.

BRIEF DESCRIPTION OF DRAWINGS

Other objects and advantages of the present invention will become immediately apparent upon reading the following detailed description and upon reference to the drawings in which:

FIG. 1 is a front view, partially in section, of a water dispenser according to the present inven- tion;

FIG. 2 is a side view, partially in section, of an embodiment of the present invention;

BEST MODES OF THE INVENTION

Figure 3:
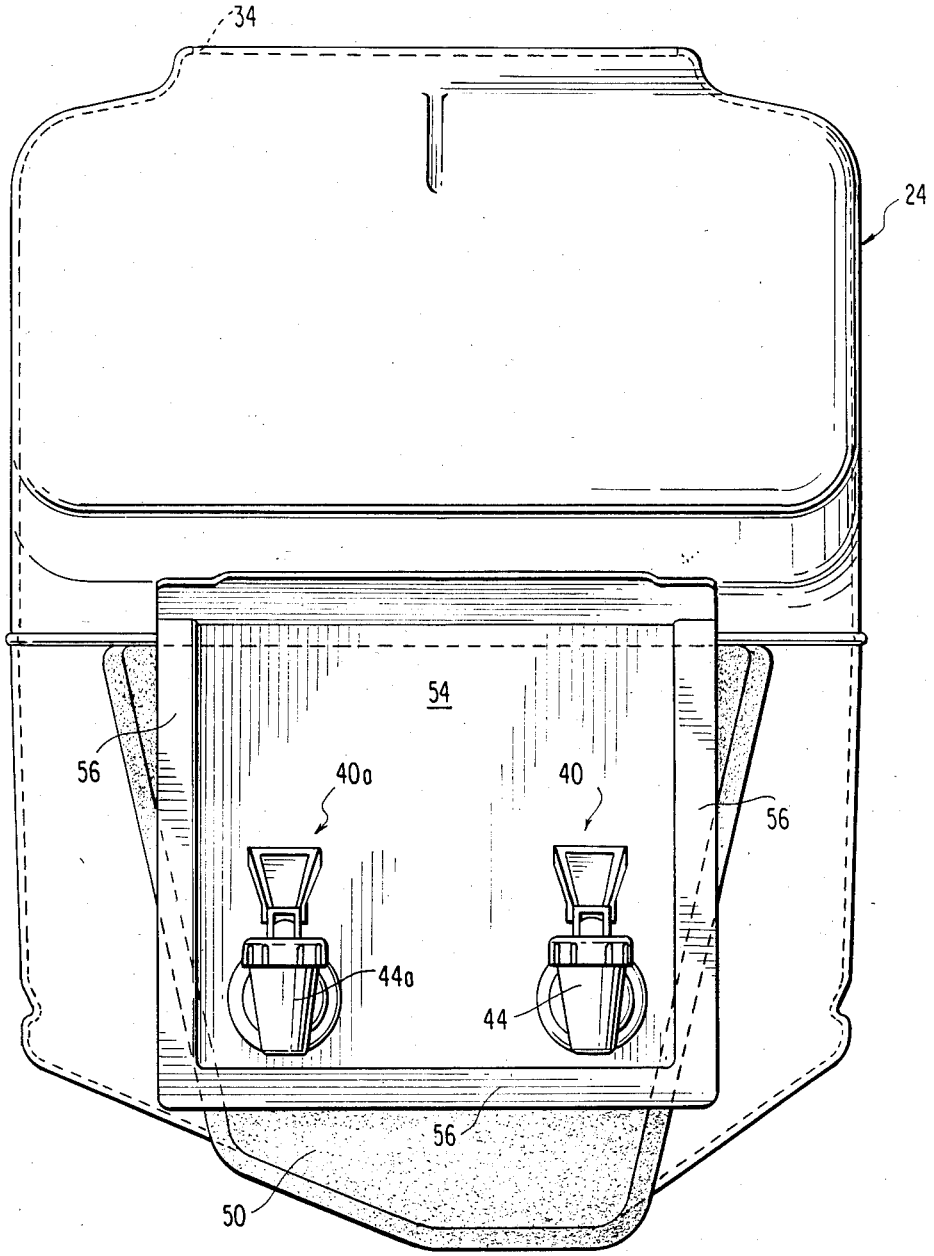
FIG. 3 is a front view of an embodiment of a liquid container according to the present invention.

While the present invention will be described in connection with preferred embodiments, it should be understood that this description is not intended to limit the present invention in any way to such embodiments. On the contrary, the description is intended to cover all alternatives, modifications and equivalents as may be included within the spirit and scope of the present invention as defined by the appended claims.

The liquid referred to herein most frequently, and that to which the present invention is expected to have most widespread application, is water. However, it should be understood that other beverages may be dispensed from the present invention.

Turning first to FIG. 1, there is shown an embodiment of the liquid dispenser of the bottled water cooler type according to the present invention. The liquid dispenser includes a cabinet or housing 10 which includes at least a front wall portion 12 and side wall portions 14 and 16. The rear of the housing may include a rear wall portion or may be left open, as is done in the preferred embodiment illustrated in FIGS. 1 and 2, to allow access to some of the mechanical and electrical components of the dispenser. If the rear of the housing is left open, in order to provide structural rigidity to the housing it is preferred that a frame such as 18 be used at the base of the housing and possibly at the upper portion of the housing. Additionally or alternatively, a cross brace 20 may be provided at the upper portion of the housing between the sidewalls 14 and 16.

A cooling or refrigeration apparatus, designated generally by 22 in FIGS. 1 and 2, includes conventional components such as a compressor, condenser, accumulator, and evaporator coils. A thermostat T, relay, and electrical cables C are located, preferably, within a lower portion of the housing 10.

Figure 7:
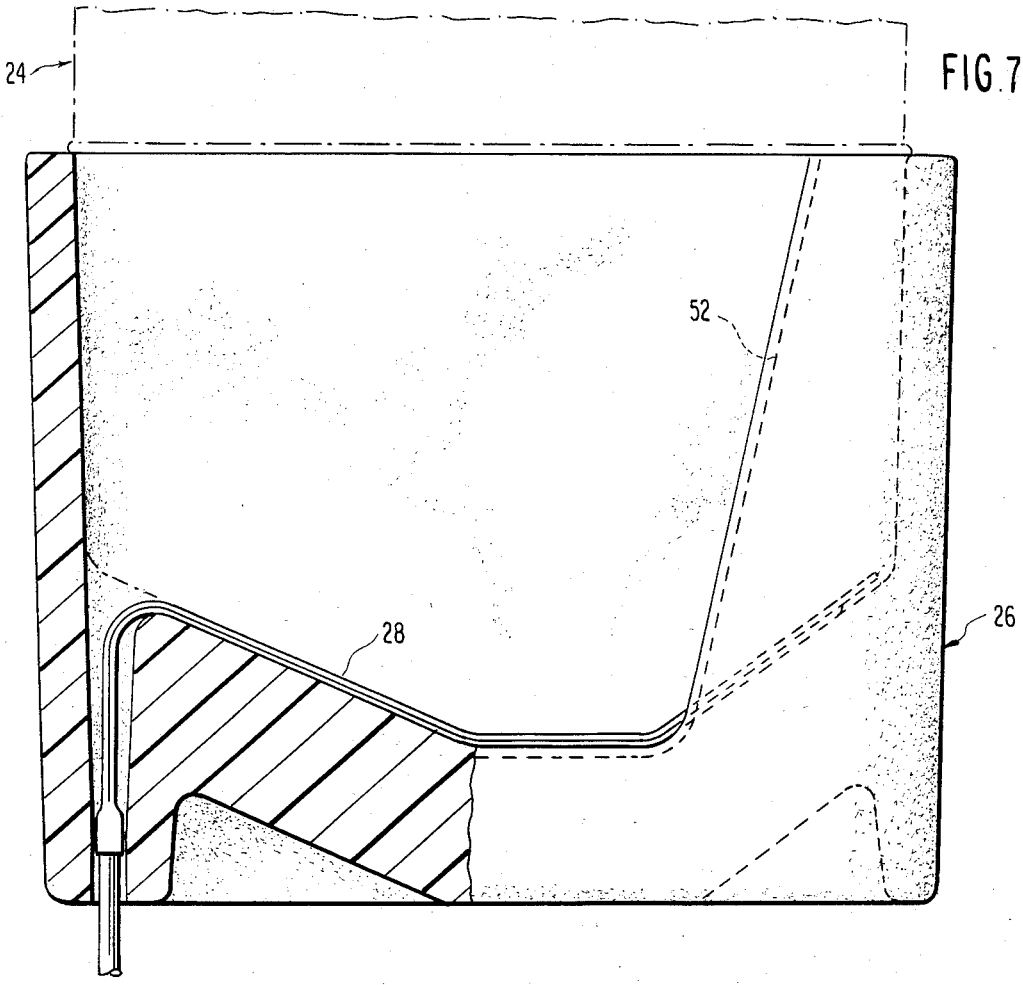
FIG. 7 is a front view, partially broken away, of an embodiment of an insulated receptacle according to the present invention.
Figure 8:
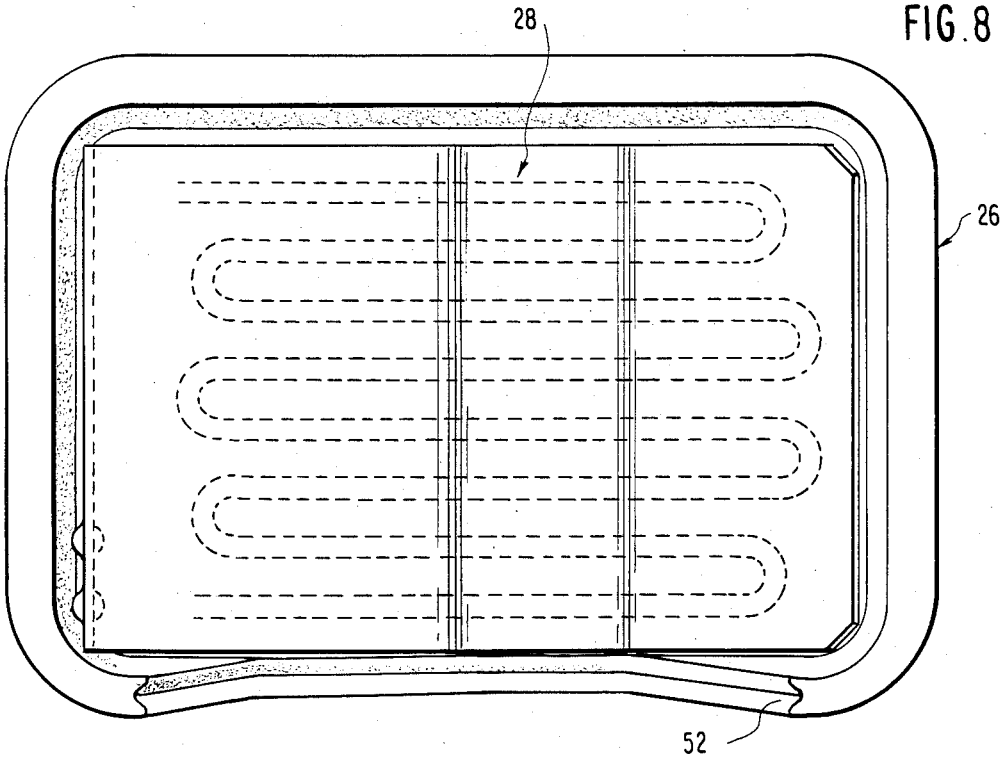
FIG. 8 is a top view of an embodiment of the insulated receptacle.

In accordance with the present invention, a vertically removable liquid container 24 is located within the upper portion of the housing surrounded and at least partially enclosed within an insulated receptacle 26 (FIGS. 7 and 8) which is mounted in the housing 10 intermediate the housing wall portions and the liquid container. Although the insulated receptacle 26 may be formed from a combination of a rigid structural material and an insulating material located either within the structural material or external thereto, it is preferable to mold the insulated receptacle as a single member with front, side, back, and bottom walls using a single material which is both rigid, thereby providing structural support, and has insulating properties. Preferably, a material such as polystyrene, for example, styrofoam, or a similar material is used in manufacturing the insulating receptacle.

In keeping with the invention, located on the upper surface of the bottom of the cavity formed by the walls of the insulated receptacle 26 is an evaporator cooling plate 28 which is formed from one or a pair of plates of a thermally conductive material having refrigerant filled coils or tubes secured to a surface of the plate (or passing between the plates when a pair of plates is employed). The refrigerant containing coils or tubes are in communication with and form part of the refrigeration apparatus 22. To increase the efficiency in cooling a lower portion of the liquid container 24, while minimizing manufacturing costs, the cooling plate 28 is provided with an irregular configuration, such as the winged or V-shape shown in FIGS. 1 and 3 rather than a planar surface. The winged configuration tends to maximize the surface area of the plate. The bottom surface of the liquid container 24 is commensurate in shape to and rests directly in contact with the cooling plate, thereby increasing the surface area of that portion of the container in contact with the cooling portion of the refrigeration apparatus.

To accommodate a liquid containment device, such as a water bottle or the like, the housing 10 is provided with a housing cover 30 having a hole 32 located therein as is the top of the liquid container 24. Thus, when the liquid container 24 is in the insulated receptacle 26, and the housing cover 30 is in place on the housing 10, the housing cover hole 32 is aligned or is in register with the liquid container hole 34 (see FIGS. 2 to 5). The aligned holes 34 and 32 permit the neck and opening of an inverted carboy or bottle 36 (FIG. 1) to be passed through and located in the upper portion of the housing 10 and liquid container 24, so that water in the bottle 36 flows into and fills the liquid container 24 which serves as a reservoir. To adequately accomodate and position the inverted carboy 36, the housing cover hole 32 is provided with an inwardly tapered and radiused collar portion commensurate in shape to the neck portion of the carboy.

To draw water from the liquid container 24 at least one liquid valve or dispensing means, designated generally as 40 (FIGS. 1–4 and 6) is provided in a wall portion, generally at the front wall 12, of the housing 10. The liquid valve means generally includes a conduit or tube 42 passing through the wall 12 and a conventional faucet or spigot 44 on the outer end thereof. To permit the coolest water to be drawn from the liquid container, that is, the water in the V-shaped bottom portion of the liquid container which is closest to the cooling plate 28, a downwardly inclined conduit or pickup tube 46 is provided as an extension of or addition to tube 42. The open end of the conduit 46 is located in the lowest region of the liquid container adjacent the bottom wall which rests on the cooling plate. To prevent the warmer water which enters the liquid container from the carboy from readily mixing with the cool water located in the bottom portion of the liquid container as cool water is drawn therefrom through the liquid valve means 40, a plate or baffle 48 is arranged horizontally in the vicinity of the liquid valve means 40. The baffle 48 prevents the circulation of water, occurring in the upper portion of the liquid container 24 caused by incoming water from carboy 36, from disturbing the temperature gradient existing across the baffle 48. The baffle may be located by a supporting ridge or shoulder formed in a lower portion of the internal surface of the reservoir or by a tapering configuration of the lower portion of the liquid container.

In some instances, a source of non-chilled water may be desired, such as for the preparation of a hot beverage. For this purpose, a second liquid valve means **40*a***

(FIGS. 1, 3 and 6) may be provided which includes a conduit or tube 42*a* passing through a wall portion of the liquid container 24 and, like liquid valve means 40, a faucet or spigot 44*a*. The liquid valve means 40*a* does not, however, necessarily include a pickup tube such as that which forms part of liquid valve means 40. The placement of the liquid valve means 40*a* is such that the tube 42*a* passes through a wall portion of the liquid container 24 at a point above the baffle 48. The combination of the location of the winged shaped chill plate below a commensurately shaped bottom portion of the liquid container to thereby chill a limited portion of water in the container and the liquid valve means drawing water from different locations within the container permits a supply of water of widely varying temperatures.

Although it is generally preferred to locate both of the liquid valve means in a side by side spaced relationship in the same wall portion of the liquid container, such an arrangement is not required.

The liquid container, baffle, tubes 42 and 42*a* and pickup tube 46 may be formed from any suitable nontoxic and noncorrosive materials. Preferably, they are formed from plastic materials which provide structural strength and rigidity while resisting fracturing. Such materials, preferably, are easily cleanable and are also resistant to the adhesion of algae or other biological substances apt to form in water remaining stagnant for a period of time. Most preferred are plastic materials such as polyethylene.

As an alternative to providing non-chilled or ambient temperature water for preparation of hot beverages, the present invention may also include a second liquid container provided with its own liquid valve means (40 and 40*a*) similar to those described above. In still another embodiment, an electrical heating element and thermostat may be provided, located preferably external to and adjacent or in contact with the second liquid container. Suitable insulation material may be provided between the first, or cooled, liquid container and the second, or heated, liquid container or in the form of a second insulated receptacle.

Further in accordance with the present invention, the liquid container 24 is provided with a means for locating the container within the water dispenser housing. The preferred embodiment illustrated in FIGS. 2, 3, 4, and 6 shows means for locating the liquid container 24 in the receptacle 26 and includes a locating panel or plate 50 which is mounted on the outer surface of the front wall portion of the liquid container 24 through which the liquid valve means passes. The locating panel 50 is inserted into and engages a notch or notch-shaped opening formed in a portion of the front wall of the insulated receptacle 26. The locating panel 50 is preferably formed from the same insulation material or materials from which the insulated receptacle is formed and has a peripheral shape which complements the notch formed in the insulated receptacle 26, herein shown as a generally arcuate opening, such as a U- or V-shaped opening. To improve the insulation and engagement effects of the peripheral edge of the locating panel 50 with the surface of the notch 52, interlocking configurations are preferably provided to the surface of the notch and corresponding peripheral edge surface of the locating panel, such as wedge and groove or tongue and groove configurations. Once placed in an operative position in the insulated receptacle 26, the external surfaces of the vertical wall portions of the liquid container substantially contact the inner surfaces of the walls of the insulated receptacle while the bottom surface of the liquid container contacts an upper surface of the cooling plate. By having this side wall contact, entry of moisture-laden air from the surrounding atmosphere is substantially blocked from entering the region adjacent the edges of the cooling plate 28 to prevent condensation being produced on the plate 28, which is adapted to be maintained at a low temperature in the range of 0 to 5 degrees Fahrenheit under the control of the thermostat T. Being maintained at a low temperature, the plate 28 chills the water in the container even though in contact with the bottom.

Figure 4:
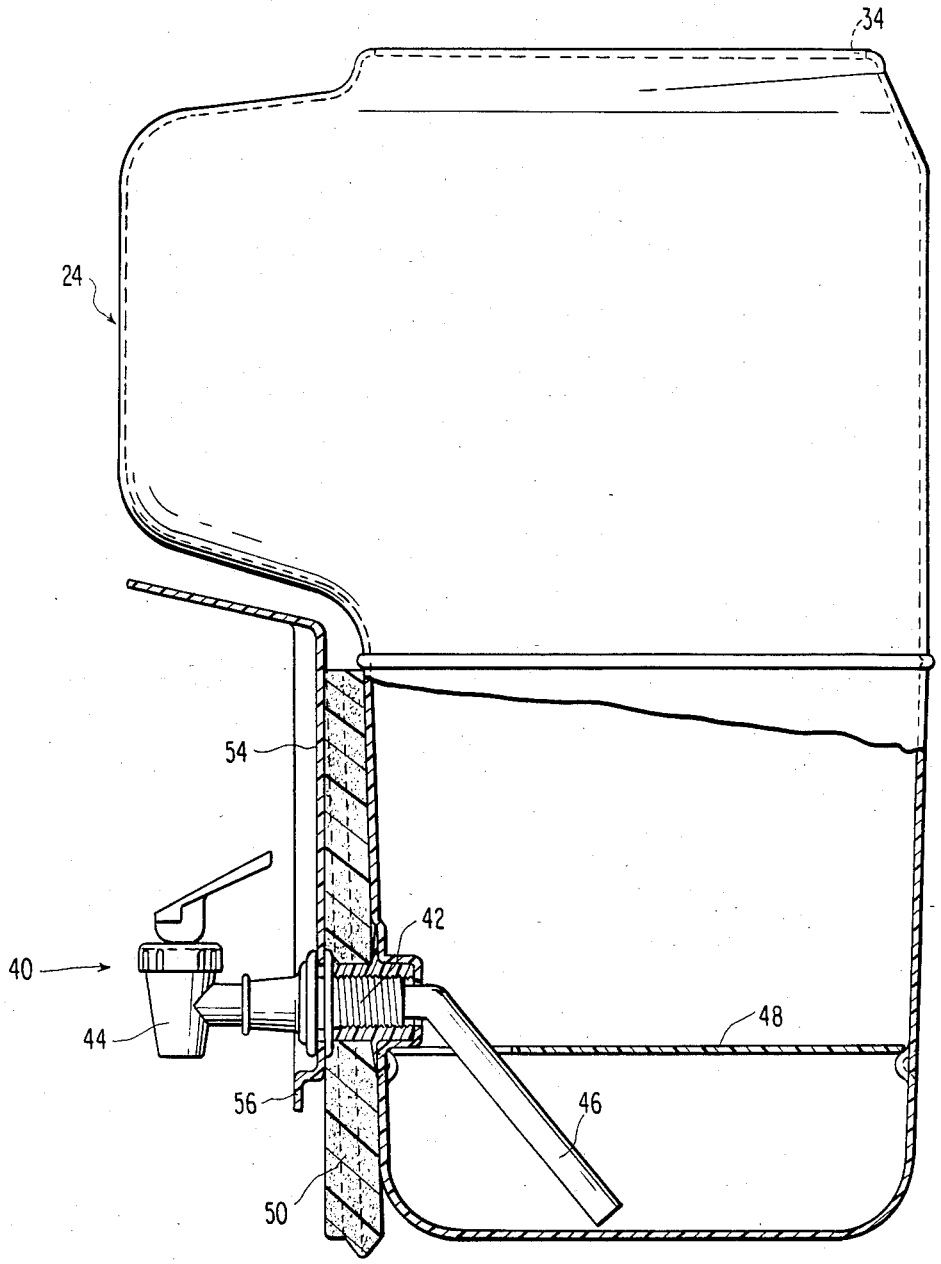
FIG. 4 is a side view, partially in section, of a liquid container.
Figure 5:
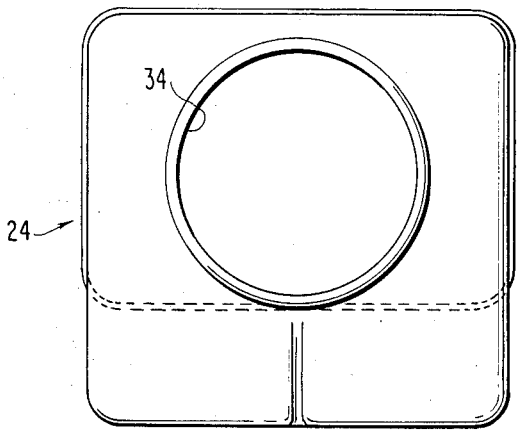
FIG. 5 illustrates a top view of a liquid container according to the present invention.

A second means for locating the liquid container within the housing of the liquid dispenser and which also serves as a securing means may be provided by an escutcheon plate 54 which is located, in the preferred embodiment as illustrated in FIGS. 1 to 4 and 6, mounted superimposed on the locating panel 50. Thus, tubes 42 and 42*a* pass through the escutcheon plate 54, the locating panel 50 and the wall portion of the liquid container and are suitably and sealingly secured therein by any convenient means known in the art. According to the invention, therefore, a drop-in, lift-out reservoir is provided in the form of a unitary assembly of the liquid container 24, the front panel 50 of insulation material, the escutcheon plate 54 and the faucet means 40, 40*a* (FIGS. 3 and 4).

Figure 6:
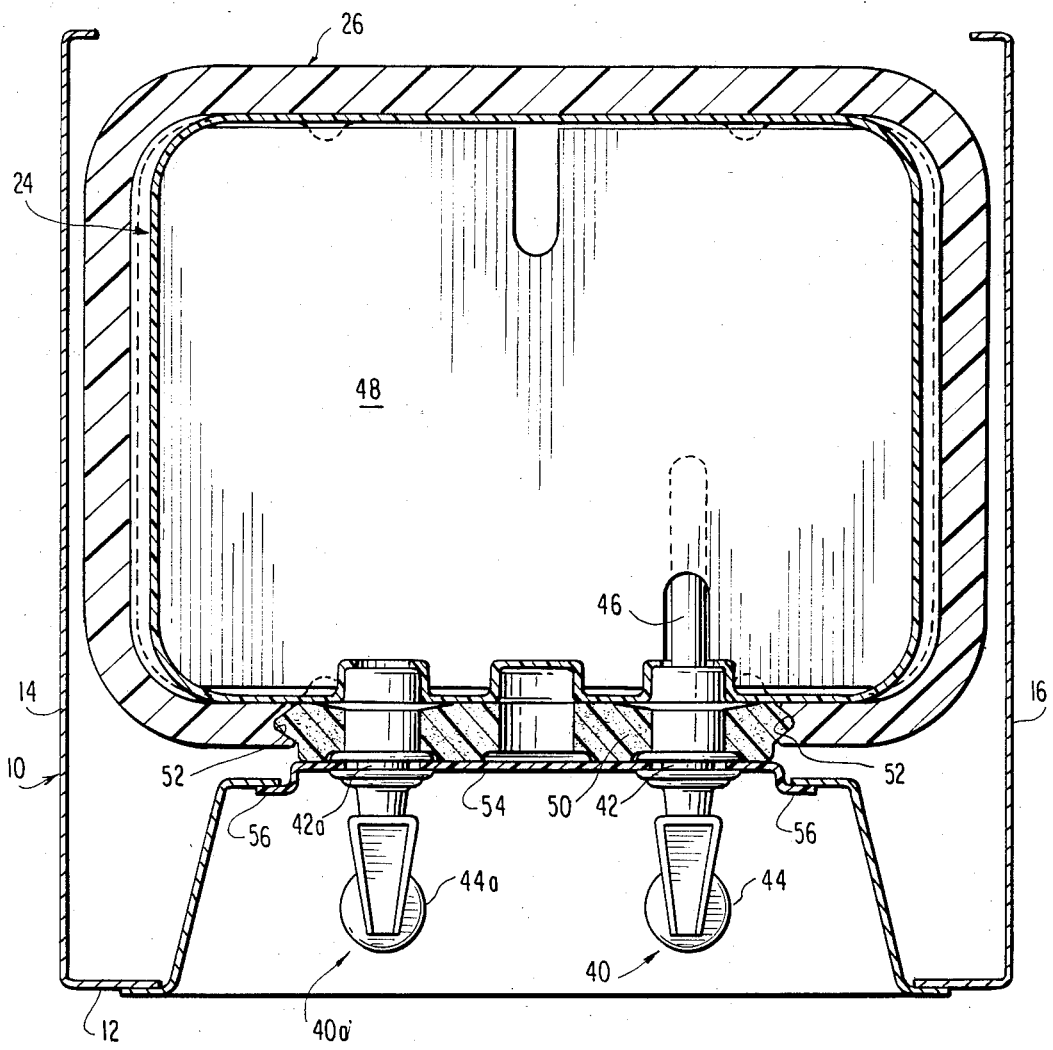
FIG. 6 is a fragmentary view of an embodiment of the locating means employed in the present inven- tion.
Figure 9:
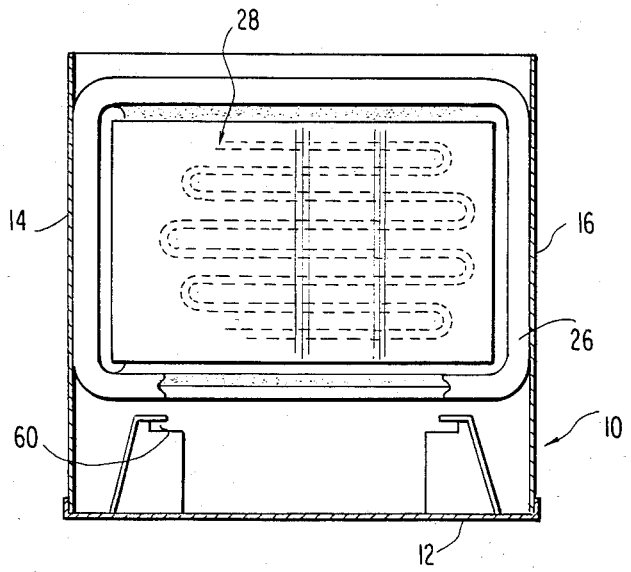
FIG. 9 is a top view of the liquid dispenser housing with the cover and liquid container removed.

The escutcheon plate 54 serves to locate and secure the liquid container 24 within the housing by engaging the periphery of a cut-out or opening formed in a portion of a wall of the housing which, in the embodiment illustrated in FIGS. 1, 2 and 6, is a front wall 12 of the housing 10, so that the escutcheon plate partially overlaps the periphery of the wall portion which defines the opening. To assist in securing the escutcheon plate in the commensurately shaped opening in the housing, the peripheral edge of the escutcheon plate 54 is provided on three sides with a lip 56. To assist both in guiding the escutcheon plate into the opening formed in the wall portion of the housing and to further improve the locating and securing effect, the portion of the housing wall containing the opening may include a horizontal slot 60 formed in a substantially horizontal upper portion 58 of a recessed region in the housing wall 12 which defines an alcove (FIG. 9). This slot also serves to guide the lip 56 when the liquid container is inserted or removed. The escutcheon plate additionally serves an aesthetic function in improving the overall appearance of the liquid dispenser.

As indicated immediately above, a preferred embodiment of the liquid dispenser of the present invention includes an alcove formed in the wall of the housing surrounding the opening through which the liquid valve means extends. This alcove may be provided so that the valve means does not project beyond the front of the housing. This also allows for the provision of a drain 62 and a drain receptacle 64 below the drain. When the housing includes such an alcove, the liquid container 24 may include a portion which projects forwardly above the alcove, thereby increasing its reservoir capacity. However, other than the preferred inclusion of a slot 60 to accommodate the lip 56 of escutcheon plate 54, the inclusion of an alcove is optional.

Figure 10:
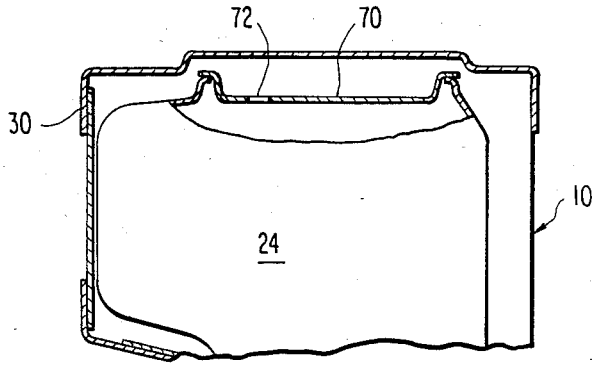
FIG. 10 is a side sectional view of an upper portion of another embodiment of the invention.

With certain modifications described below, the present invention may be employed in a liquid-dispensing apparatus using a totally self-contained liquid container. That is, with embodiments described below, the provision for including an inverted water bottle or carboy may be omitted. Thus, as illustrated in FIG. 10, a removable top or cover 30 for the housing may be provided which does not include a hole. The liquid container, which in most respects is constructed as the liquid container 24, described above, may be filled through a hole located in an upper portion of the container, such as hole 34. However, the hole may be sealed off with a suitable cover or cap 70, which is preferably removable. To permit a consistent rate of flow of liquid through the liquid valve means, a means for equilibration of pressure may be provided, such as a vent 72 located in the top portion of the liquid container, such as in the cover itself.

The liquid dispensing apparatus, particularly the liquid container described immediately above, permits refilling either by the user or by a beverage supplier. Another embodiment of the present invention includes a liquid container which is a sealed unit. That is, the container comprises a one-piece liquid container without a refilling hole in the top portion thereof or one in which the cap 70 is sealed in place. Such a liquid container unit may be refilled by the beverage supplier, using known filling means, and returned to the user. A vent or other pressure equilibration means may be provided in the liquid dispensing container.

While the invention has been described in conjunction with specific embodiments thereof, it is evident that many alternatives, modifications and variations will be apparent to those skilled in the art in light of the foregoing description. Accordingly, the present invention is intended to embrace all such alternatives, modifications and variations as those which fall within the spirit and broad scope of the appended claims.

We claim:

1. A liquid-dispensing apparatus having a drop-in/lift-out reservoir comprising:

a housing having an opening in a front vertical wall thereof and a removable top;

an insulated receptacle positioned within said housing;

a substantially horizontal cooling plate within a lower portion of said insulated receptacle;

a vertically removable liquid container adapted to be dropped into and lifted out of said insulated receptacle after removal of said top of the housing and providing a reservoir, the bottom of said container resting on and being in heat exchange relation with said cooling plate, liquid valve means integrally incorporated in a wall portion of said liquid container and located to project through said front wall opening in said housing and accessible be a user with said liquid container located in said insulated receptacle; and means in said housing for locating said liquid container in said insulated receptable;

said locating means comprising a generally arcuate opening located in a wall of said insulated receptacle and said container including a corresponding arcuate opening-engaging panel secured to the wall portion of said liquid container through which said valve means pass.

2. The liquid dispensing apparatus of claim 1 wherein said container includes an escutcheon plate secured to the wall portion of said liquid container through which said valve means pass, said escutcheon plate in register with and engaging the wall portion of said housing having said opening.

3. The liquid dispensing apparatus of claim 1 wherein a lower portion of said liquid container is commensurate in shape to said cooling plate.

4. The liquid dispensing apparatus of claim 3 wherein said cooling plate has a winged shape.

5. The liquid dispensing apparatus of claim 1 wherein said arcuate opening-engaging panel and said insulated receptacle are formed from the same material.

6. The liquid dispensing apparatus of claim 1 wherein said liquid valve means includes at least one faucet and at least one conduit passing through a vertical wall of said liquid container and said arcuate opening-engaging panel providing fluid communication between said at least one faucet and the interior of said liquid container.

7. The liquid dispensing apparatus of claim 6 wherein said liquid valve means includes two faucets and two conduits associated with each of said faucets, the open end of one of said conduits located adjacent the bottom wall of the liquid container.

8. The liquid dispensing apparatus of claim 1 wherein a baffle is provided within a lower portion of said liquid container.

9. A liquid dispensing apparatus, having an upright housing, comprising:

a removable cover for the top of said housing having a hole adapted to receive the neck of an inverted bottle;

an insulated receptacle fixed within the housing and having vertical walls and an opening in one wall thereof;

a cooling plate within a lower portion of said insulated receptacle and having a substantially horizontal portion;

a vertically removable liquid container adapted to be dropped into and lifted out of said insulated receptacle having vertical walls, said container having a bottom resting on said portion and commensurate in shape to said portion of said cooling plate and a top having an aperture aligned with the hole in said removable housing top;

an insulated panel, at least a portion of which having an arcuate shape corresponding to the opening in said insulated receptacle, said insulated panel secured to a vertical wall of said liquid container;

an escutcheon plate on the outside of said insulated panel;

means for locating said liquid container in said insulated receptacle and said escutcheon plate in register with an opening in a vertical wall of said housing; and liquid dispensing means including faucet means projecting forward of the escutcheon plate and a conduit means passing through said escutcheon plate, said insulated panel and said vertical wall of said liquid container, said conduit means providing fluid communication between said faucet means and the interior of said liquid container;

said liquid container, said insulated panel, said escutcheon plate, and said liquid dispensing means providing a unitary assembly to be dropped into and lifted out of said housing through the top of said housing.

10. In a water dispenser unit having an upright housing, the combination comprising:

a removable cover for the top of said housing, said cover having substantially a central hole adapted to receive an inverted bottle containing water;

an insulated, open-topped, box-like receptacle member mounted in the housing having front, side, back and bottom walls defining an open-topped cavity, and a notch in the front wall of said member open to the top of said front wall;

a cooling plate on the upper surface of the bottom wall of the receptacle member cavity;

a liquid container adapted to be dropped into the open top of said housing and into the cavity in said receptacle member and having side and back walls engaging said receptacle member and a bottom wall adapted to rest on said cooling plate at the bottom of said cavity, said container having a hole in a top wall thereof adapted to register with the hole in the top of said housing and to receive the neck of a bottle inverted and resting on said housing;

an insulated panel fixed on the outside of the front wall of said container having a shape conforming to the notch in the front wall of said insulated receptacle and fitting closely therein with the container nested in the cavity in the insulated receptacle member;

an escutcheon plate on the outside of said insulated panel;

faucet means fixed on the front wall of said escutcheon plate and projecting forwardly from approximately a central portion of said escutcheon plate and said insulated panel and having a connection therethrough to the interior of said container for dispensing water therefrom;

said container, insulated panel and escutcheon providing a unitary assembly to be dropped into the housing through the open top into the interior cavity of said insulated receptacle member; and means on said front wall of said housing cooperating with said escutcheon to locate said container within the cavity of said insulated receptacle member.

11. A liquid-dispensing apparatus having a drop-in/lift-out reservoir comprising:

a housing having an opening in a front vertical wall thereof and a removable top;

a box-shaped insulated receptacle positioned within said housing having vertical side walls and a substantially horizontal bottom wall of insulation material;

a substantially horizontal cooling plate inside said insulated receptacle adjacent the bottom wall thereof and adapted to be maintained at a temperature in the range of 0 to 5 degrees Fahrenheit;

a vertically removable liquid container adapted to be dropped into and lifted out of said insulated receptacle, said container having a bottom wall contacting said cooling plate and vertical side walls contacting said vertical side walls of said insulated receptacle and substantially blocking entry of moisture-laden air from the surrounding atmosphere to the region adjacent the edges of said cooling plate to prevent condensation being produced thereon;

liquid valve means integrally incorporated in a wall portion of said liquid container and located to project through said front opening in said housing and be assessible by a user with said liquid container located in said insulated receptacle; and means in said housing for loacting said liquid container in said insulated receptacle comprising a generally arcuate opening located in a wall of said insulated receptacle and said container including a corresponding arcuate opening-engaging panel secured to a vertical wall portion of said liquid container through which said valve means pass.

12. A liquid-dispensing apparatus having a drop-in/lift-out liquid container comprising:

a housing having an opening in a front vertical wall thereof and a removable top;

an insulated receptacle positioned within said housing;

a cooling plate within a lower portion of said insulated receptacle;

a vertically removable liquid container adapted to be dropped into and lifted out of said insulated receptacle, said liquid container provided with a means for equilibrating pressure, liquid valve means integrally incorporated in a wall portion of said liquid container and located to project through said opening in said housing and accessible by a user with said liquid container located in said insulated receptacle; and means in said housing for locating said liquid container in said insulated receptacle comprising a generally arcuate opening located in a wall of said insulated receptacle and said container including a corresponding arcuate opening-engaging panel secured to a vertical wall portion of said liquid container through which said valve means pass.

13. The liquid dispensing apparatus of claim 12 wherein said pressure equilibration means comprises a vent.

14. The liquid dispensing apparatus of claim 13 wherein said vent is located in a removable cap.

15. The liquid dispensing apparatus of claim 14 wherein a lower portion of said liquid container is commensurate in shape to said cooling plate.

16. The liquid dispensing apparatus of claim 15 wherein said cooling plate has a winged shape.

17. The liquid dispensing apparatus of claim 12 wherein said container includes an escutcheon plate secured to the wall portion of said liquid container through which said valve means pass, said escutcheon plate engaging the wall portion of said housing having said opening.

18. The liquid dispensing apparatus of claim 12 wherein said arcuate opening-engaging panel and said insulated receptacle are formed from the same material.

* * * * *